US006550378B1

(12) United States Patent
Wales, Jr.

(10) Patent No.: US 6,550,378 B1
(45) Date of Patent: Apr. 22, 2003

(54) WASTE COMPACTOR

(76) Inventor: Hal Wales, Jr., P.O. Box 98, South Pasadena, CA (US) 91031

( * ) Notice: Subject to any disclaimer, the term of this patent is extended or adjusted under 35 U.S.C. 154(b) by 48 days.

(21) Appl. No.: 09/685,294

(22) Filed: Oct. 10, 2000

(51) Int. Cl.[7] ..... B30B 1/00
(52) U.S. Cl. ..... 100/229 A; 100/225; 100/237
(58) Field of Search ..... 100/225, 237, 100/221, 193, 46, 227, 229 A

(56) References Cited

U.S. PATENT DOCUMENTS 3,438,321 A * 4/1969 Gladwin ..... 100/221
4,073,228 A * 2/1978 Henzl ..... 100/52
5,119,722 A * 6/1992 Carter et al. ..... 100/221
5,179,895 A * 1/1993 Bauer ..... 100/193
5,690,025 A * 11/1997 Hawkins ..... 100/229 A

* cited by examiner

*Primary Examiner*—Allen Ostrager
*Assistant Examiner*—Shelley Self
(74) *Attorney, Agent, or Firm*—James E. Brunton

(57) ABSTRACT

A vertical waste compactor that includes a pair of side-by-side packing rams that provide increased compaction force on waste materials contained within an open-top trash receiving container that can be conveniently moved inwardly and outwardly of a supporting frame that supports the dual packing rams. The packing rams are driven by a pair of hydraulically actuated assemblies that are supported by the device housing and are pivotally connected to the compaction rams.

20 Claims, 14 Drawing Sheets

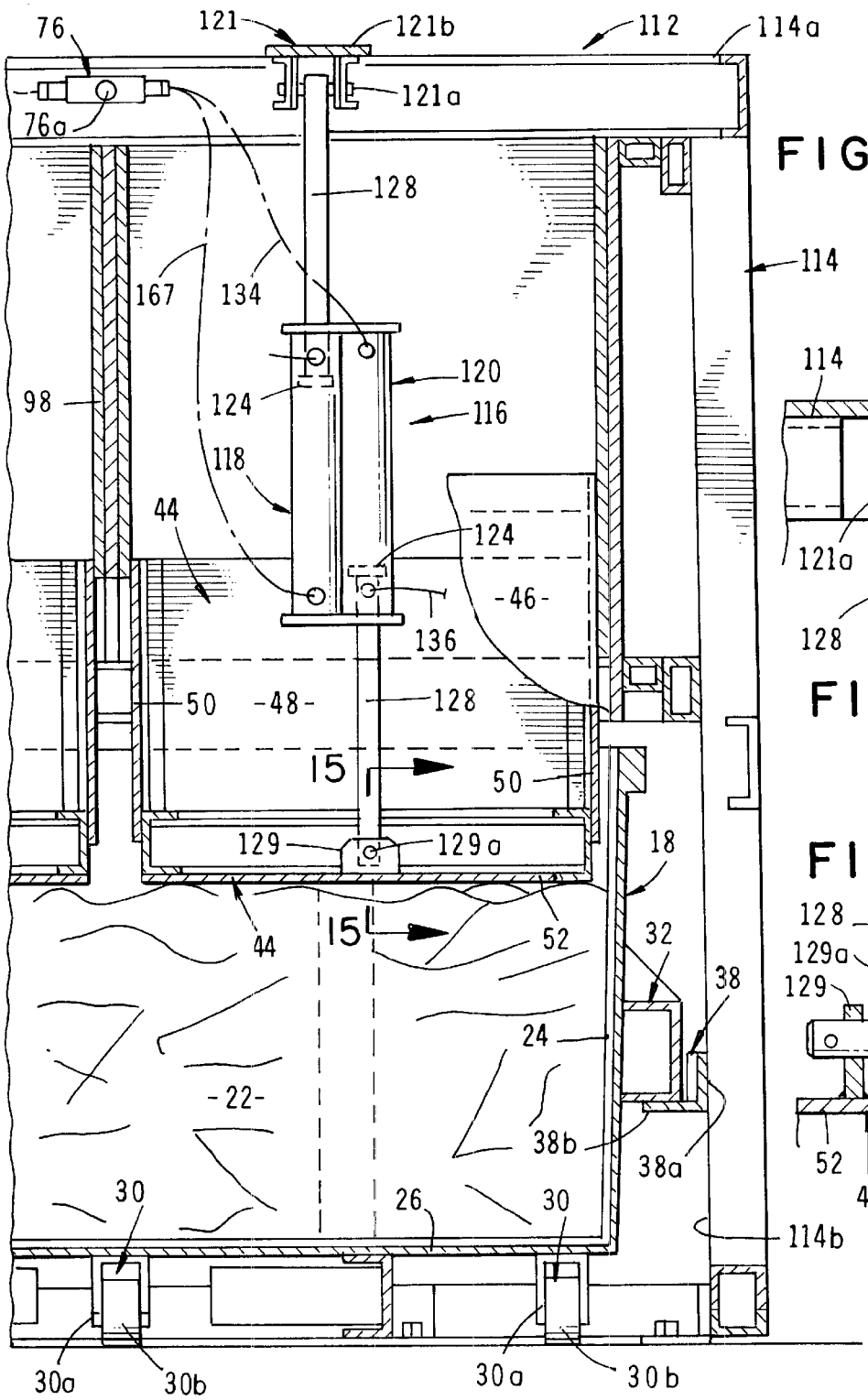
FIG.12B
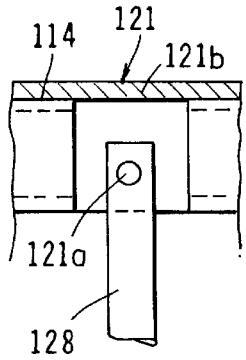
FIG.14
FIG.15
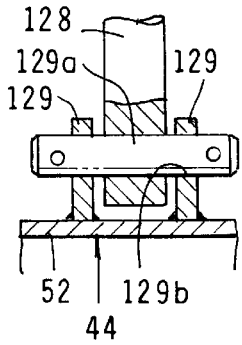

WASTE COMPACTOR

BACKGROUND OF THE INVENTION

1. Field of the Invention

The present invention relates generally to a compactor for waste material. More particularly, the invention concerns a dual-ram, high-density, industrial-type vertical waste compacting apparatus.

2. Discussion of the Prior Art

Waste production in the United States has reached enormous proportions and continues to increase. To better dispose of this waste and to relieve overburdened land fills, a number of different types of home and industrial type trash compactors have been suggested.

Home trash compactors are usually quite small and generally comprise a small, vertically operated ram which moves within a small trash compactor body to compact domestic type waste materials placed into the body. Industrial-type trash compactors, are generally much larger than home trash compactors, and typically comprise either pivotally mounted or vertically operated ram components that compact trash disposed within a container of several cubic foot capacity allowing the waste material to be contained within a smaller cubic foot space.

Exemplary of a prior art, pivotally mounted, ram-type unit is that described in U.S. Pat. No. 4,235,165 issued to Fenner et al. The Fenner et al compactor packs waste material in an open top container which is adapted for movement inwardly and outwardly of a supporting frame. The ram unit of the device is pivotally supported at one end by the frame with its other end being selectively movable to an extended position within the container to a retracted position above the container and to an intermediate position proximate the top of the container. A housing encases the ram unit and has an opening for feeding waste material into the container while the ram unit is in the intermediate position. A power unit is operatively connected to and moves the ram unit selectively to the extended, retracted and intermediate position.

Exemplary of a prior art, vertically movable, ram-type unit is that described in U.S. Pat. No. 4,603,626 issued to Nall et al. The Nall et al device is provided with a ram component having a single inclined surface so that on the ram's downward compacting stroke, a horizontal force is created through the trash acting on the bin wall to press the bin against a retaining bar thereby preventing "walking" or horizontal movement of the bin.

Various other types of vertically movable, ram-type units have been suggested in the past that embody multi-action ram movements and elaborate control systems that require substantial maintenance and eventually cause system failure in the field. Typically, these prior art trash compactors are of complex in design, are costly to manufacture and maintain, and, in some cases are quite difficult to use. Additionally, many of the more complex prior art compactors do not efficiently pack the waste material and as a result fail to effectively minimize trash storage and pick-up expense.

The thrust of the present invention is to overcome the drawbacks of the prior art trash compactors by providing a compactor that is of simple, a rugged design that efficiently maximizes compaction ratios in order to substantially reduce trash storage and pick-up expense.

SUMMARY OF THE INVENTION

It is an object of the present invention to provide a novel, vertical waste compactor that is ideally suited for efficient trash disposal for apartments, condominiums hospitals, hotels and various other industrial and commercial facilities.

Another object of the invention is to provide a waste compactor of the aforementioned character that uniquely comprises a pair of side-by-side packing rams that provide increased compaction force on waste materials contained within the open top trash receiving container of the apparatus that can be conveniently moved inwardly and outwardly of a supporting frame that supports the dual packing rams.

Another object of the invention is to provide a waste compactor of the character described which is of a simple design, is easy and safe to use and requires minimum maintenance.

Another object of the invention is to provide a vertical waste compactor that embodies an energy efficient hydraulic system which allows for motor horsepower reduction and high hydraulic system pressure.

Another object of the invention is to provide a waste compactor of the class described in the preceding paragraphs that is uniquely designed to maximize the capability of the compactor to develop high density compacted loads.

Another object of the invention is to provide a waste compactor that is economical to construct, is efficient in operation, is durable and long lasting and effectively avoids problems associated with scavengers and rodents.

In summary, the novel trash compaction apparatus of the invention comprises a housing having a closed-in upper portion and a front opening lower portion, and a top open container for receiving the waste to be compacted. The container is easily movable from a first position within the lower front open portion of the housing and a second position outwardly of said housing. First and second side-by-side rams are mounted within housing for simultaneous movement from an upper position within the upper portion of the housing to an extended position within the housing and finally to an extended trash compaction position within the top open container. An operating mechanism of a simple, straight forward design operates the dual rams and in the preferred form of the invention comprises a pair of cooperating hydraulic rams that controllably move the rams through the compaction cycle.

BRIEF DESCRIPTION OF THE DRAWINGS

FIGS. 12A and 12B, when taken together, comprise a view similar to FIGS. 10A and 10B, but showing the compaction rams of this latest form of the invention.

FIG. 13 is a greatly enlarged, cross-sectional view of the area designated as "13" in FIG. 12A.

FIG. 14 is a cross-sectional view taken along lines 14—14 of FIG. 13.

FIG. 15 is a cross-sectional view taken along lines 15—15 of FIG. 12B.

DESCRIPTION OF THE INVENTION

Figure 1:
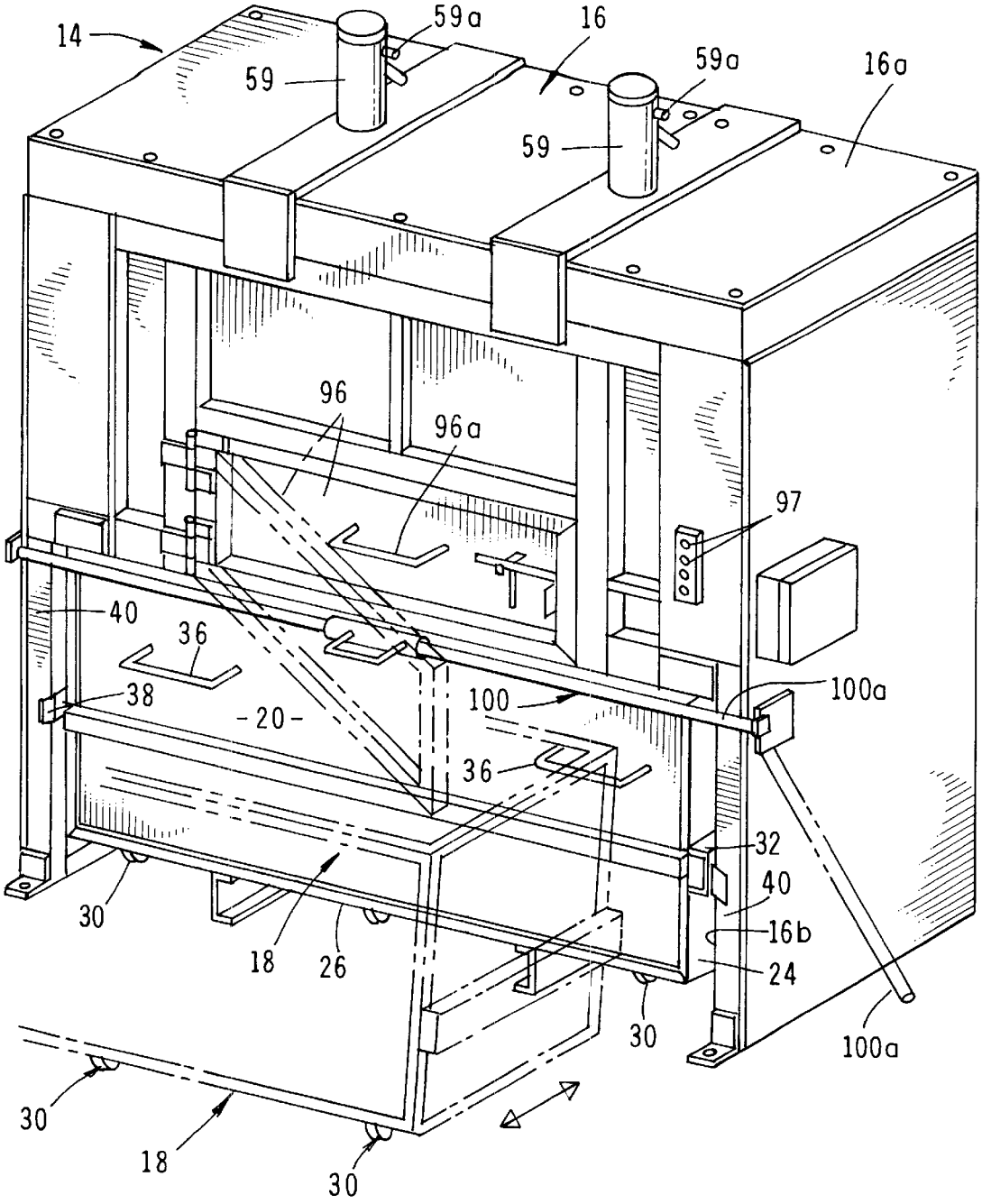
FIG. 1 is a generally perspective view of one form of the waste material compactor of the present invention.

Referring to the drawings and particularly to FIGS. 1, 2, 3A and 3B, one form of the apparatus for compacting waste is there shown and generally designated by the numeral 14. As indicated in FIG. 1, the apparatus comprises a housing 16 having a closed upper portion 16*a* and a front open lower portion 16*b*. Receivable within front open lower portion 16*b* is a top open container 18 for receiving the waste to be compacted. Container 18 is movable from a first position shown by the solid lines in FIG. 1 wherein the container is disposed within housing 16 to a second position shown by the phantom lines in FIG. 1 wherein the container is in an outwardly position relative to of housing 16.

Figure 2:
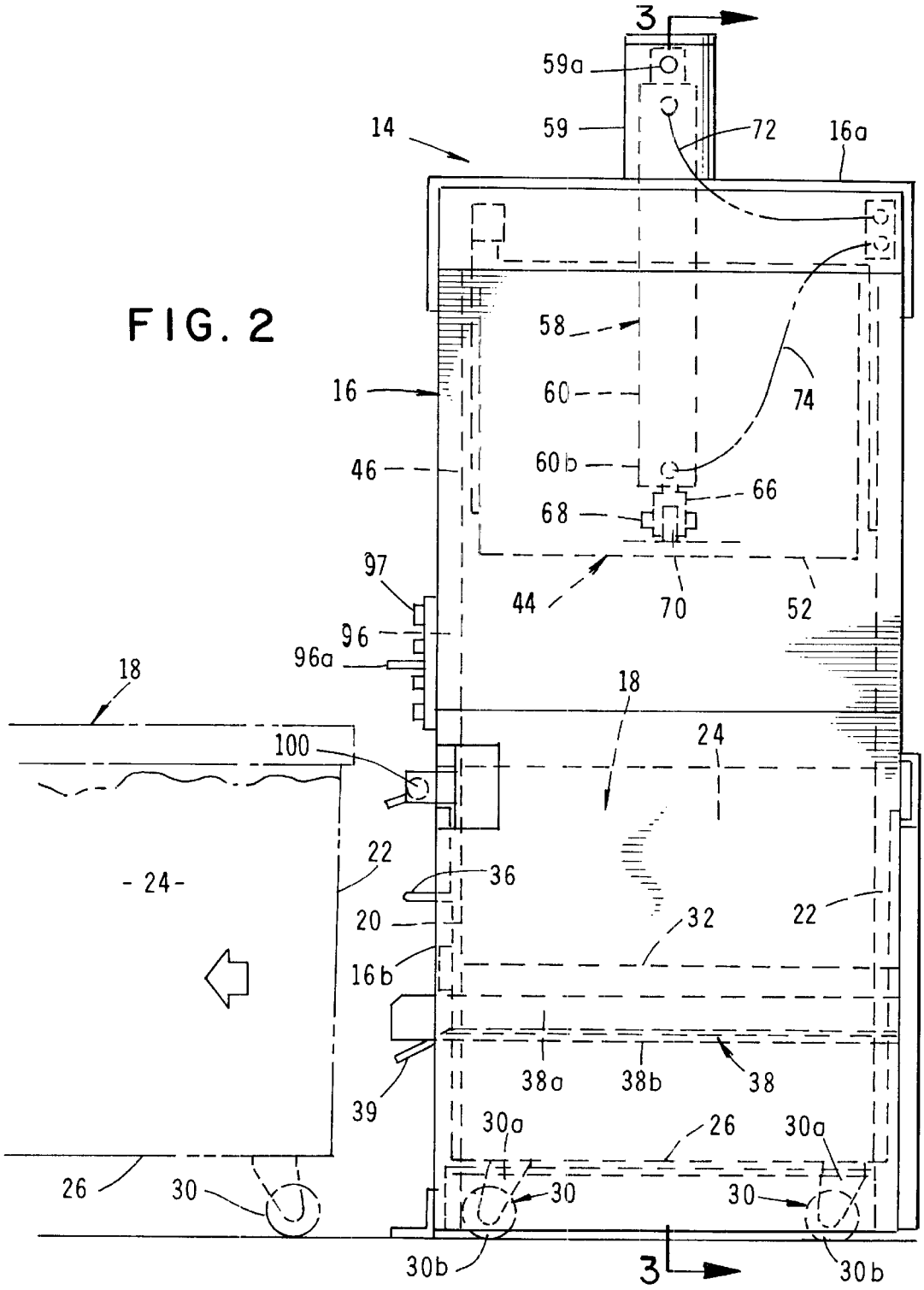
FIG. 2 is a side elevational, diagrammatic view of the waste compactor shown in FIG. 1 illustrating the removal of the top open container from the lower portion of the housing of the apparatus.
Figure 3A:
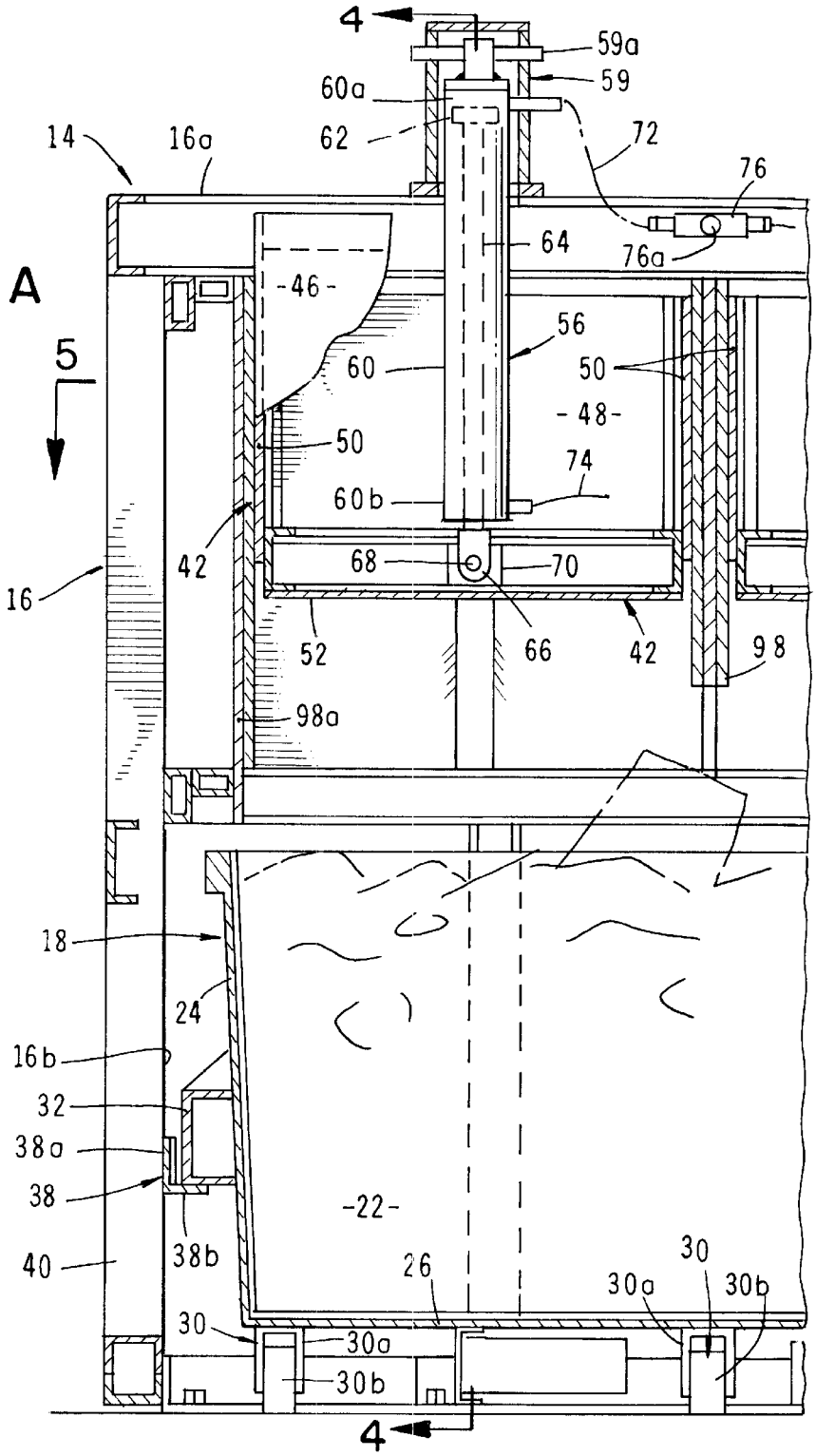
FIGS. 3A and 3B, when considered together, comprise a cross-sectional view taken along lines 3—3 of FIG. 2.
Figure 3B:
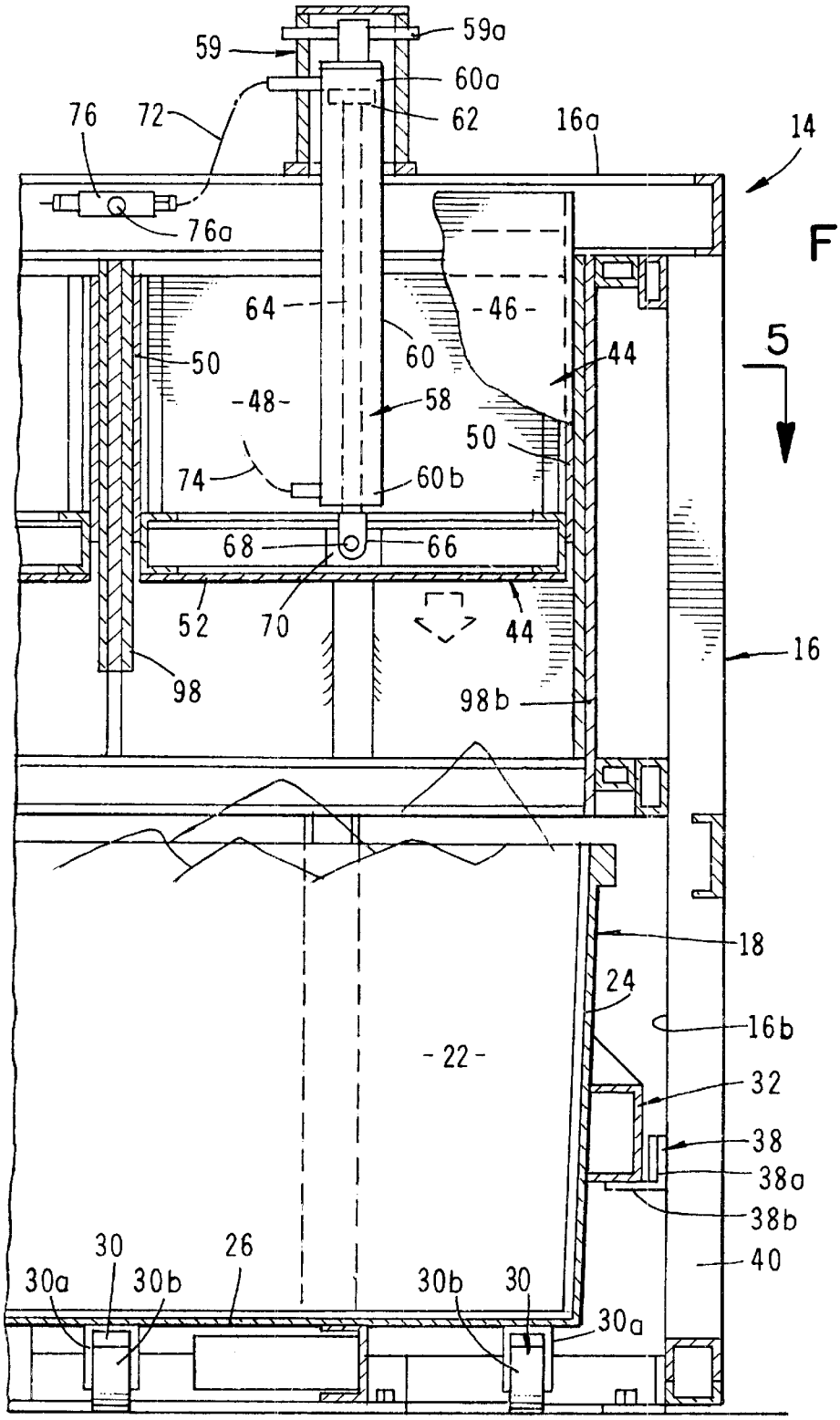
Figure 4:
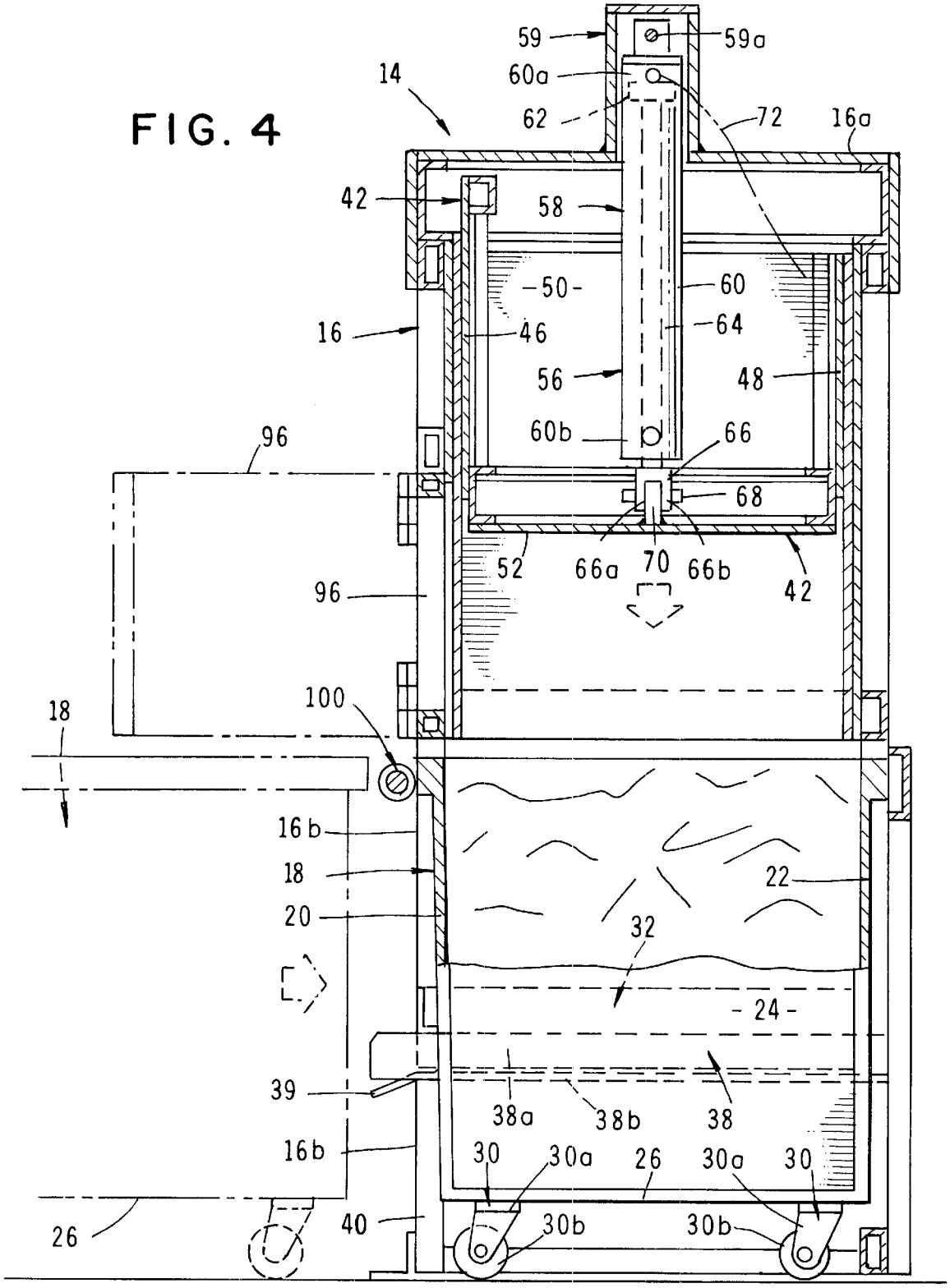
FIG. 4 is a cross-sectional view taken along lines 4—4 of FIG. 3A.

As indicated in FIGS. 2, 3A and 3B, container 18 comprises a bin-like structure having interconnected front, rear, side and bottom walls 20, 22, 24, and 26 respectively. Interconnected with bottom wall 26 are a plurality of spaced apart caster assemblies 30. Caster assemblies 30 are of conventional construction each having a yoke-like body portion 30*a* adapted to rotatably support a roller 30*b*. As best seen by referring to FIGS. 3A and 3B, sidewalls 24 of container 18 slope slightly inwardly. Affixed to sidewalls 24 are C-shaped beams 32, the purpose of which will presently be described. As best seen in FIG. 1, container 18 is provided with spaced-apart, generally U-shaped handles 36 which can be used to roll the waste receiving container from the compaction position shown in FIG. 1 to the outward position shown by the phantom lines in FIGS. 1 and 2.

An important feature of the apparatus of the present invention resides in container support means which support the container within housing 16 during the compaction steps. These support means here comprise a pair of angle irons 38 that are affixed to the steel legs or column members 40 of housing 16. More particularly, the vertically extending legs 38*a* of each of the angle brackets 38 are connected as by welding to columns 40 so that the horizontal legs 38*b* of the angle bracket extend inwardly into the lower open portion of housing 16 in the manner best seen in FIGS. 3A and 3B. When the waste container is in the compaction position shown by the solid lines in FIGS. 1, 3A and 3B, side beams 32 engage and are supported by the inwardly extending legs 38*b* of angle brackets 38. To assist in guiding beams 32 into position over legs 38*b*, the forward extremities 39 of each of the legs extends forwardly of housing 16 and is bend down in the manner best seen FIG. 2. With this construction, as the container 18 is rolled into the compaction position within the lower portion 16*b* of housing 16, side beams 32 will slide over legs 38*b* of angle brackets 38 in the manner shown in FIGS. 3A and 3B so as to provide rigid support to the container 18 so long as the container is in the compaction position within housing 16.

Figure 5:
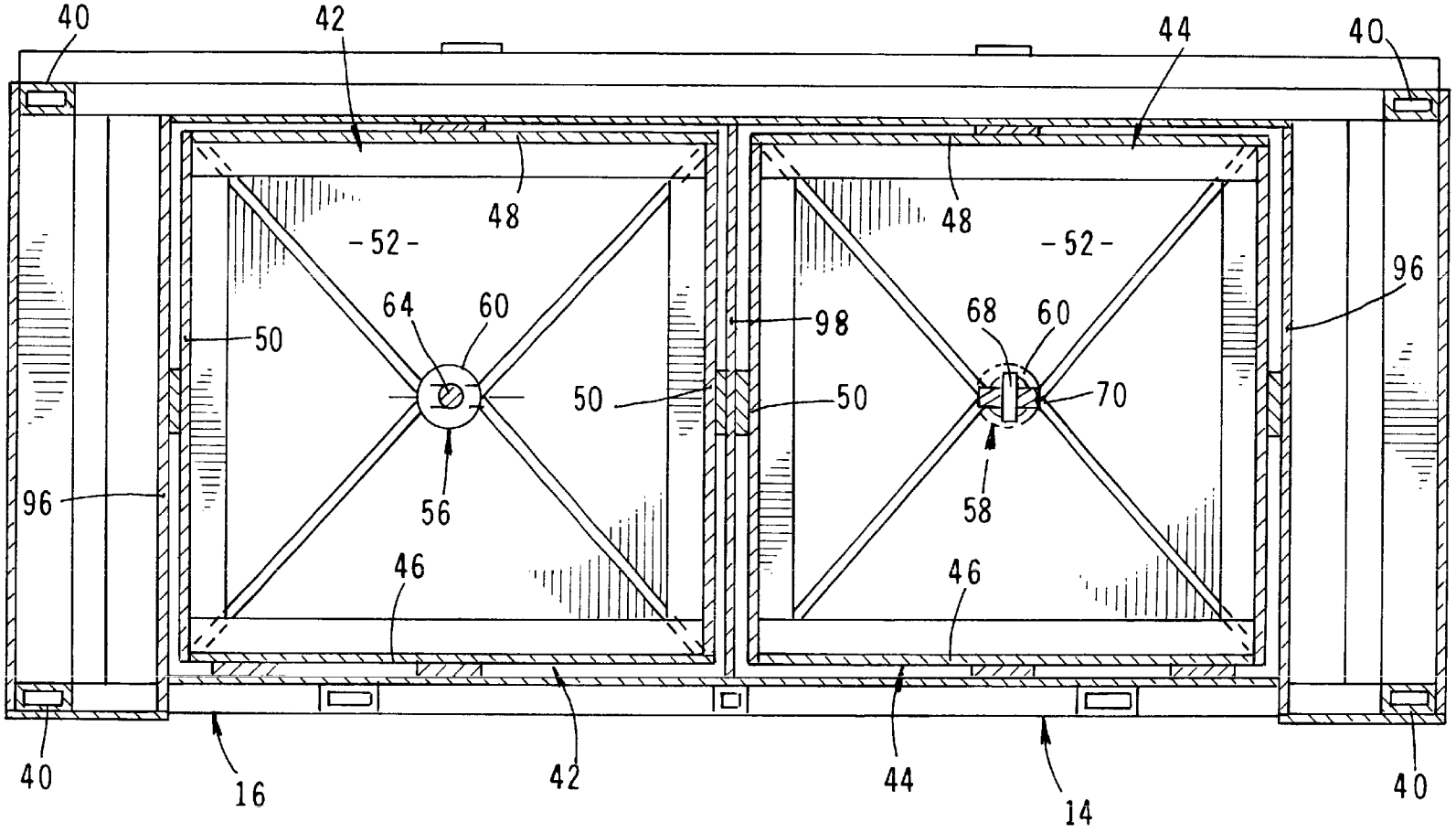
FIG. 5 is a cross-sectional view taken along lines 5—5 of FIGS. 3A and 3B.

Another very important feature of the apparatus of the invention comprises the novel compaction means of the invention for compacting trash contained within container 18. This unique compaction means here comprises first and second compaction rams 42 and 44 which are connected to housing 16 for movement between an upper position shown in FIGS. 3A and 3B into a lowered compaction position shown in FIGS. 6A and 6B. As best seen in FIG. 5 each of the compaction rams 42 and 44 include interconnected front, rear, side and bottom walls 46, 48, 50 and 52 respectively (see also FIGS. 3A and 3B).

Figures 6A, 7:
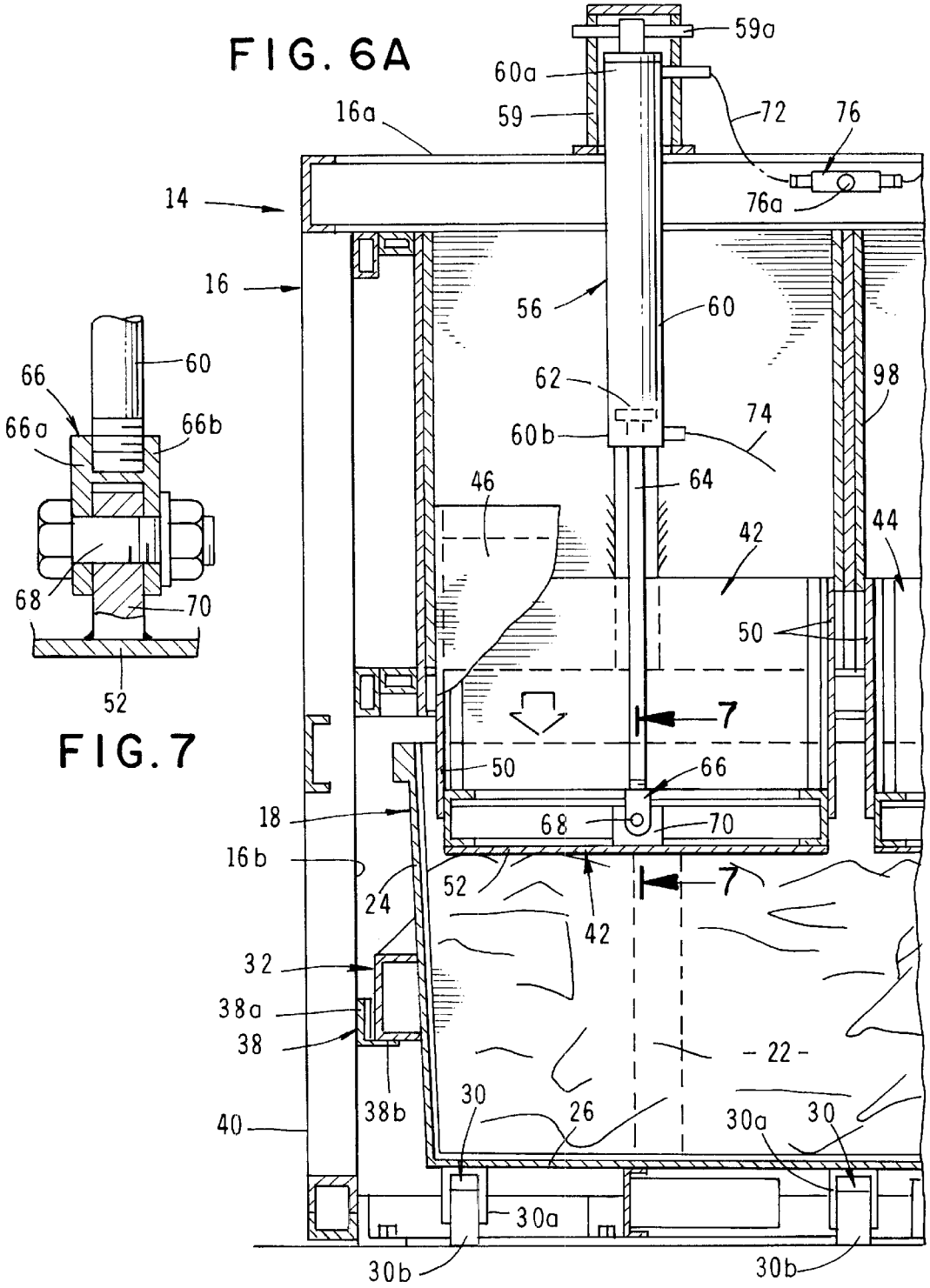
FIGS. 6A and 6B, when taken together, comprise a view similar to FIGS. 3A and 3B but showing the compaction rams of the apparatus in a lowered position compacting the waste contained within the top open container.
FIG. 7 is a greatly enlarged, cross-sectional view taken along lines 7—7 of FIG. 6A.
Figure 6B:
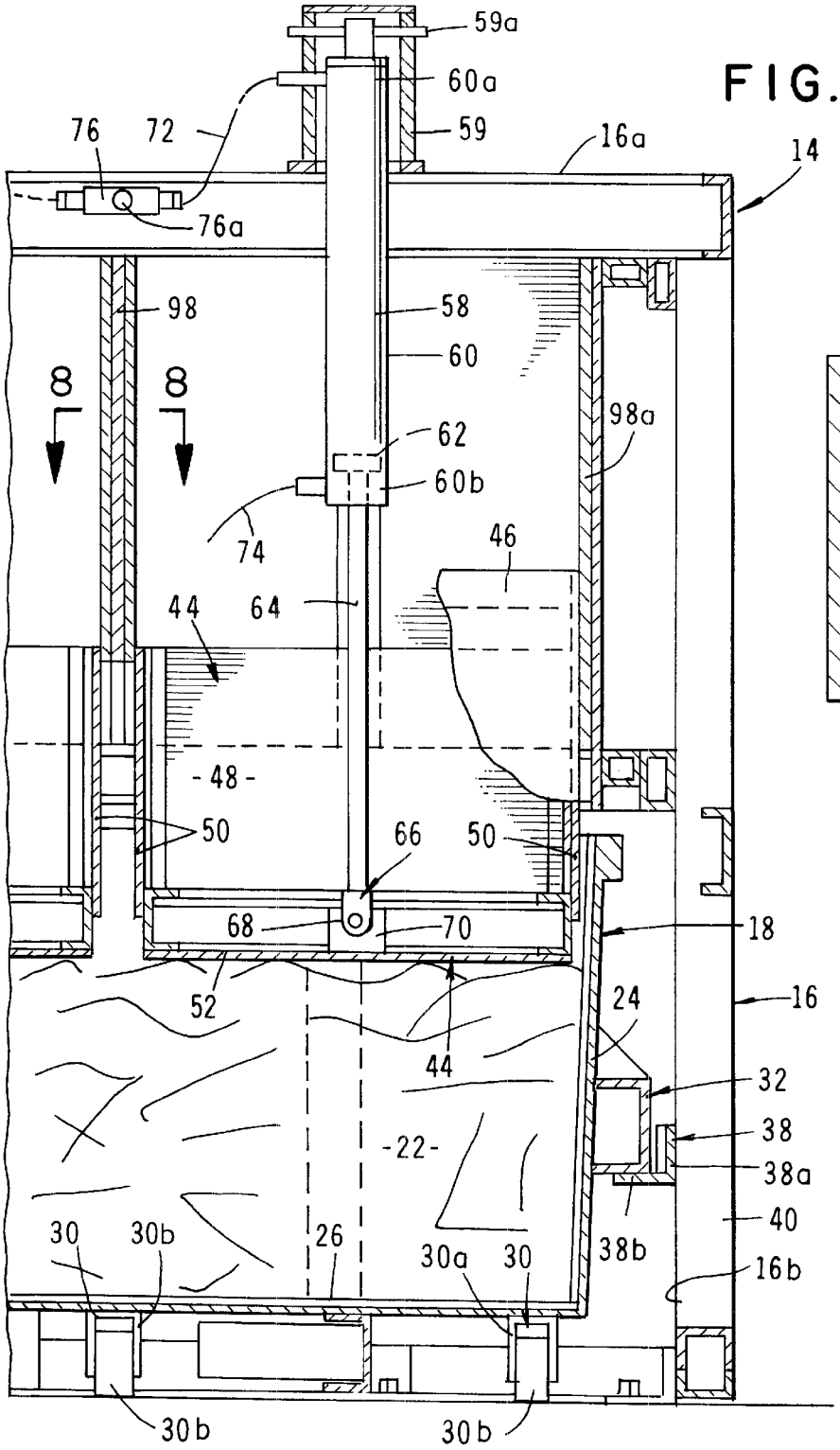

Also forming a part of the compaction means of the invention is operating means which are connected to the first and second compaction ram for controllably moving the compaction ram between the first upper position shown in FIGS. 3A and 3B into the second extended, or compaction, position shown in FIGS. 6A and 6B. In the present form of the invention, this important operating means comprises a first hydraulic assembly 56 that is connected to ram 42 and a second hydraulic assembly 58 that is connected to second compaction ram 44. Hydraulic assemblies 56 and 58 are of identical construction and are connected to housing 16 by means of an upstanding support tube 59 and cross pin 59*a* in the manner best seen in FIGS. 3A and 3B. Each of the hydraulic assemblies comprises a hydraulic cylinder 60 within which a piston and connecting rod 62 and 64 respectively reciprocate. Each of the connecting rods 64 terminates in a connector means for pivotally connecting the connecting rod to the top of a selected compaction ram. This novel connector means is here provided as a yoke-like connector component 66 within which a mounting or connector pin 68 is journaled in the manner best seen in FIG. 7. Mounting pin 68 extends through the spaced-apart sides 66*a* and 66*b* of yoke body 66 and also extends through an upwardly extending connector element 70 that is affixed to bottom wall 52 of each of the compaction rams 42 and 44 as by welding (FIG. 7).

Figure 9:
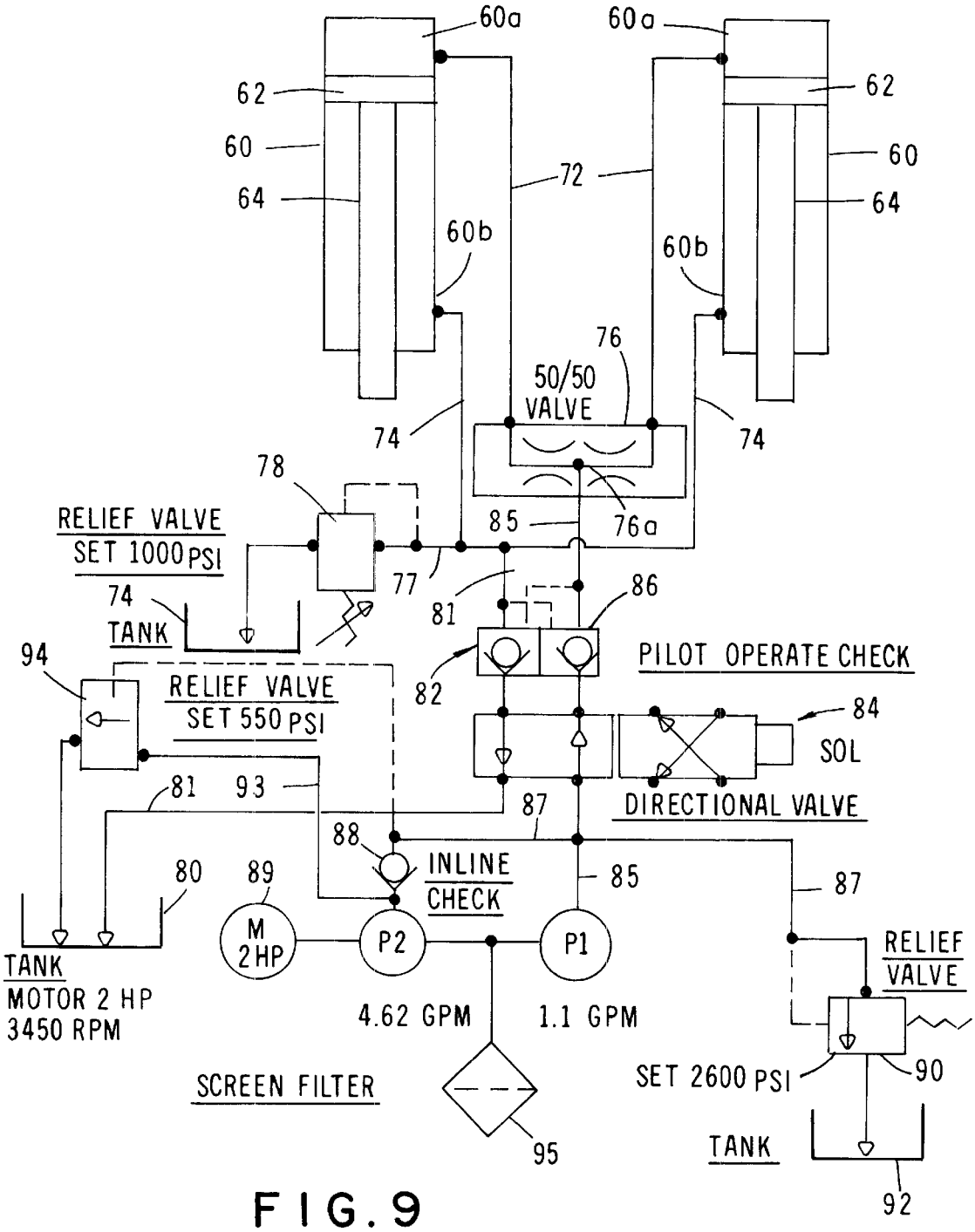
FIG. 9 is a generally schematic view illustrating the construction of the hydraulic operating system of the apparatus of the invention for moving the compaction rams from the upper most position shown in FIGS. 3A and 3B to the compaction position shown in FIGS. 6A and 6B.

Hydraulic lines 72 and 74 extend from distribution or 50/50 valves 76 which are connected to housing 16 in the manner best seen in FIGS. 3A and 3B. More particularly, hydraulic lines 72 extend from valves 76 to the upper portion 60*a* of each of the hydraulic cylinders 60 so that hydraulic fluid introduced into portion 60*a* will force piston 62 downwardly within the hydraulic cylinder (see also FIG. 9). Extending from the lower extremity 60*b* of each of the hydraulic cylinders 60 are hydraulic lines 74 that function to interconnect hydraulic cylinders 60 with a tank 75 via a hydraulic line 77 and a conventional relief valve 78 preferably set at about 1000 pounds per square inch (p.s.i.) (FIG. 9). As best seen by referring to FIG. 9, hydraulic line 77 also communicates with a tank 80 via a hydraulic line 81, a conventional pilot-operated check valve 82 and a conventional solenoid operated directional valve assembly 84.

The central port 76*a* of 50/50 valve 76 communicates with a Pump P-1 via hydraulic line 85, a conventional pilot-operated check valve 86 and directional valve 84 in the manner shown in FIG. 9. Hydraulic line 85 also communicates with a Pump P-2 via a hydraulic line 87 and an in-line check valve 88. Pumps P-1 and P-2 are driven by a conventional two horsepower electrical motor 89 and Pump P-1 communicates via lines 85 and 87 and a relief valve 90 with a tank 92, while Pump P-2 communicates with tank 80 via a hydraulic line 93 and a conventional relief valve 94 preferably set at about 550 p.s.i. All of the components of the hydraulic system that are interconnected in the manner shown in FIG. 9 are readily commercially available and their interconnection and construction are well understood by those skilled in the art. The relief valves 78, 90 and 94 are, of course, incorporated into the hydraulic system for safety purposes and a screen filter 95 communicates with Pumps P-1 and P-2 in order to filter particulates from the hydraulic fluid.

By way of illustration, each of the dual compaction cylinders 56 and 58 preferably has a 3 inch bore and a 30 inch stroke. It is to be understood, however, that, depending upon the end application to be made of the apparatus of the invention, hydraulic assemblies 56 and 58 can be of various sizes and the hydraulic system used to provide working fluid to the cylinders can be varied from that shown in FIG. 9 in manners well understood by those skilled in the art.

In operating the apparatus of the invention, with the top open container in position within the lower portion of the housing 16 in the manner shown by the solid lines in FIG. 1, hingedly connected door 96 can be swung open in the manner indicated by the phantom lines in FIG. 1 by grasping handle 96*a*. With the door open, waste materials can be placed in the top open container with relative ease. When the trash within the container has reached the level within the stroke of the twin compaction rams, door 96 is shut and the power is turned on by conventional control switches 97 (FIG. 1) so as to energize motor 89. When motor 89 is energized, Pump P-1 will provide fluid under pressure to the upper portion 60*a* of the hydraulic cylinder via hydraulic lines 72 and 85, directional valve 84 and check valve 86. This fluid under pressure will simultaneously force the compaction rams 42 and 44 downwardly from the position shown in FIGS. 3A and 3B to the position shown in FIGS. 6A and 6B so as to exert an even compaction force on the waste material contained within the top open container 18. As the twin rams move toward the bottom of the stroke the trash will begin to compact imparting only a downward force against the trash, but also a horizontal force toward the sides of the container.

As the piston 62 of the hydraulic assemblies move downwardly within the hydraulic cylinders, the hydraulic fluid will be forced to flow into tank 75 in the manner shown in FIG. 9 for reuse in the next cycle upon operation of directional valve 84.

Figure 8:
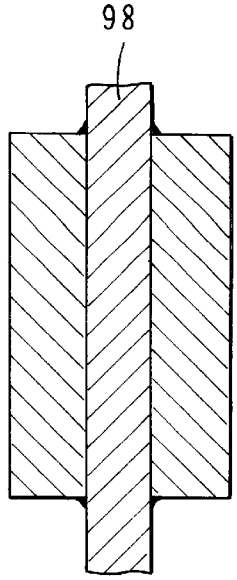
FIG. 8 is a greatly enlarged, cross-sectional view taken along lines 8—8 of FIG. 6B.

As best seen in FIGS. 3A, 3B, 6A, and 6B, a novel feature of the apparatus of the present invention comprises a center dividing wall assembly 98, which is of a construction best seen in FIGS. 6B and 8. Wall assembly 98, along with the side walls of housing 16, guide the travel of the compaction rams evenly and smoothly downwardly from the upper position shown in FIGS. 3A and 3B to the lower compaction position shown in FIGS. 6A and 6B. Clearance is strategically provided between the central wall assembly 98 and the side walls 96 of the housing (FIG. 5) so that the compaction rams, which can pivot slightly about pivot pin 68 (see also FIG. 7), will permit the compaction rams to travel smoothly downwardly into the trash container without seizing or binding within the upper portion of housing 16. In this regard, experience has shown that if the single compaction ram is used in lieu of the dual compaction rams unique to the apparatus of the present invention, the compaction ram will frequently bind against the interior walls of the housing unless expensive and sophisticated guide systems are provided to enable precise downward travel of the compaction ram within the housing 16. By using the dual ram arrangement shown in FIGS. 3A and 3B, this expensive ram guiding mechanism is not required and the dual rams can be successfully guided by the simple structural arrangement shown in the drawings.

Conventional limit switches (not shown) are provided so that the compactor will not operate unless a container is positioned within the lower portion of housing 16 and secured in position by the locking means of the invention that is here provided as the container locking bar mechanism generally designated in FIG. 1 by the numeral 100. This novel locking bar mechanism retains the top open container within the housing and secures the container against movement during the compaction cycle thus uniquely avoiding the common walking problem experienced by prior art compaction devices during compaction. Limit switches (not shown) are also provided to ensure that the throw end or 100*a* of the locking bar is closed and locked in order for the apparatus of the invention to operate. When the top open container is full, an indicating light (not shown) will illuminate indicating to the operator that the container is fill of compacted trash. When this indication is received, locking bar mechanism 100 can be operated so that the top open container 18 can be rolled away from housing 16 for picking up by conventional front-end loader refuse trucks in a manner well understood by those skilled in the art. Strategic sizing of the top open container and the twin compaction ram maximizes the capability of the apparatus to develop high density compacted loads.

Turning next to FIGS. 10 through 16, an alternate form of the apparatus for compacting waste is there shown and generally designated by the numeral 112.

This latest form of the invention is similar in many respects to that shown in FIGS. 1 through 9 and like numerals are used in FIGS. 10 through 16 to identify like components. The main difference between the earlier described embodiment of the invention and that shown in FIGS. 10 through 16 resides in the use of two, side-by-side hydraulic assemblies to drive each of the compaction rams rather than a single hydraulic assembly. As before, the apparatus of this latest embodiment comprises a housing 114 having a closed upper portion 114*a* and a front open lower portion 114*b*. Receivable within front open lower portion 114*b* is a top open container 18 for receiving the waste to be compacted. Container 18 is of the same construction and operation as previously described herein as is the support means that supports the container within housing 16 during the compaction steps.

Figures 10A, 11:
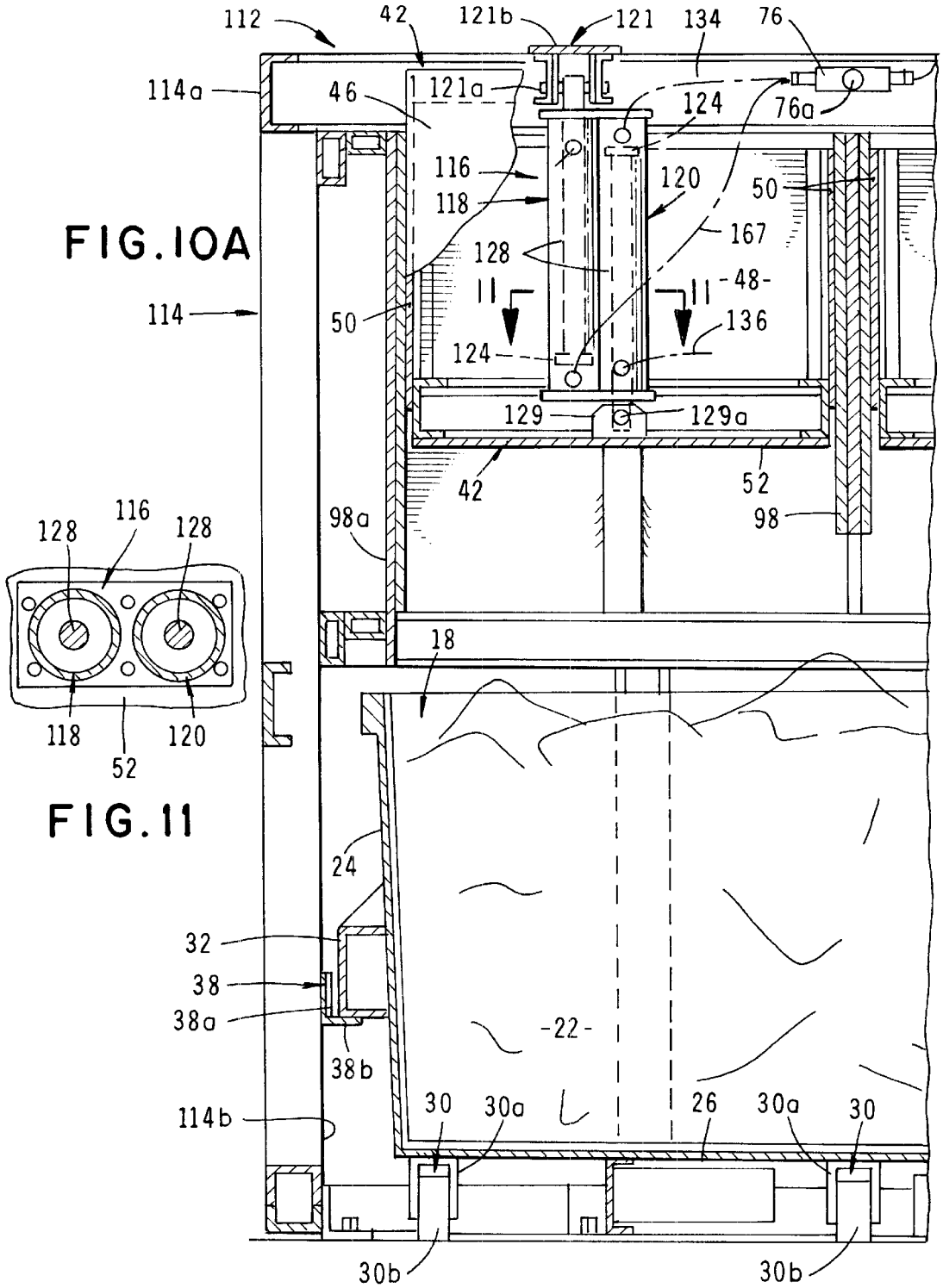
FIGS. 10A and 10B, when considered together, comprise a cross-sectional view of an alternate form of waste material compactor of the present invention.
FIG. 11 is a cross-sectional view taken along lines 11—11 of FIG. 10A.
Figure 10B:
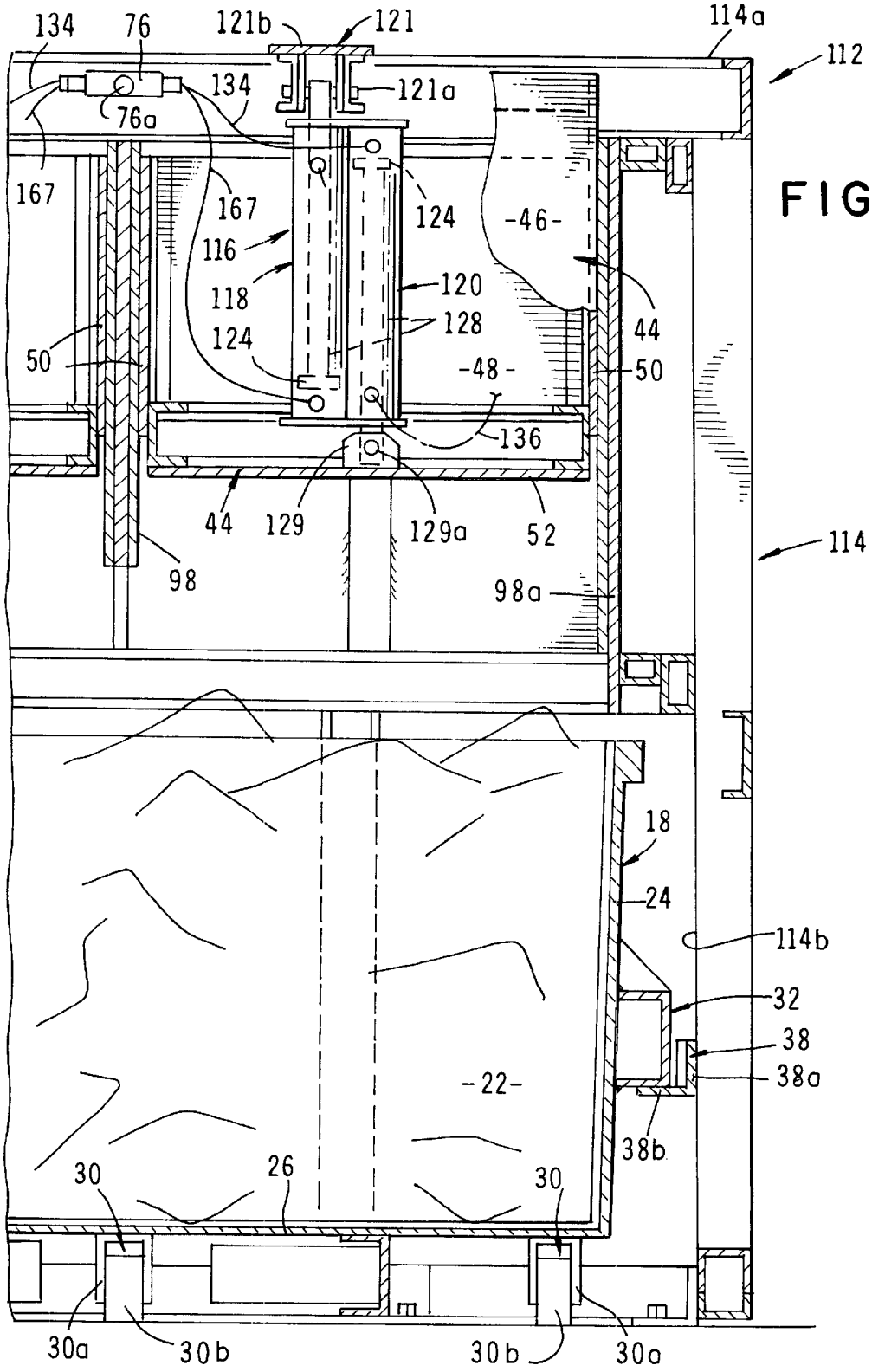
Figures 12A, 13:
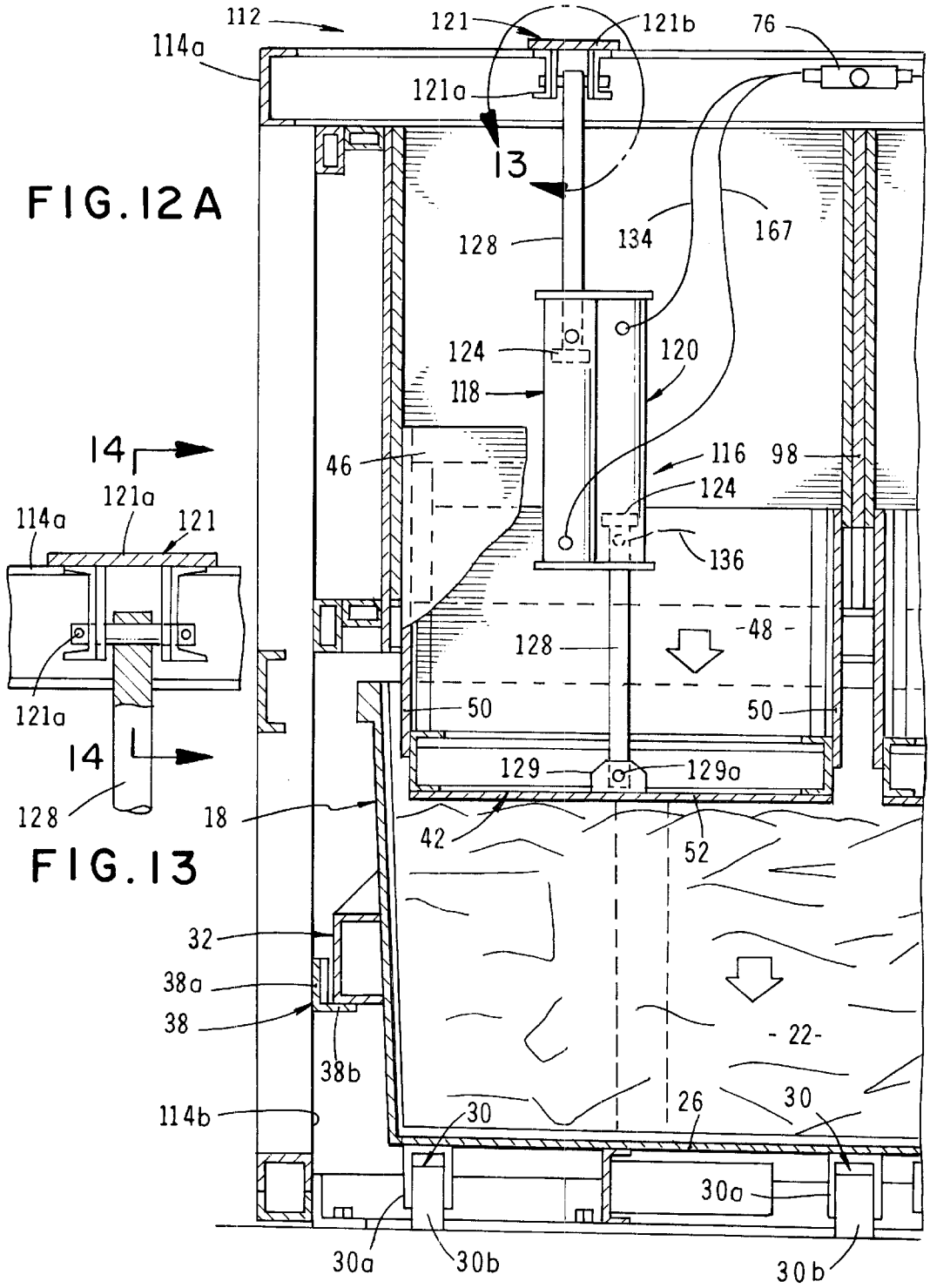

As best seen in FIGS. 12A and 12B, the compaction means of this latest form of the invention also comprises first and second compaction rams 42 and 44 which are connected to housing 114 for movement between an upper position shown in FIGS. 10A and 10B into a lowered compaction position shown in FIGS. 12A and 12B. However, as previously mentioned, the operating means of this latest embodiment are of a novel twin hydraulic assembly construction with each of the first and second compaction rams being driven by an assemblage 116 made up of first and second interconnected hydraulic cylinders 118 and 120 respectively. Hydraulic assemblages 116 are of identical construction and each assemblage is connected to housing 114 by a support bracket 121 and cross pin 121*a* (FIGS. 13 and 14). It is to be noted that, unlike the tubular support 59 of the earlier described embodiment, bracket 121 does not comprise a tubular segment that extends upwardly of the top surface of housing 114, but rather comprises a flat top plate 121*b*. This important low-profile feature of the apparatus is possible because of the novel twin cylinder construction of the hydraulic assemblages 116 next to be described.

As illustrated in FIGS. 10A and 11, each of the cylinders 118 and 120 houses a reciprocating piston and connecting rod 124 and 128 respectively. The connecting rods 128 that reciprocate within hydraulic cylinders 120 are connected to the compaction rams by novel connector means for pivotally connecting the connecting rod to the compaction ram. This connector means here comprises spaced-apart, upstanding members 129 that are welded to bottom plates 52 of the compaction rams (FIG. 15). Members 129 are apertured to receive a connector pin 129*a* that extends through bore 128*b* formed in connecting rods 128. In similar manner, the upper ends of each of the connecting rods that reciprocate within cylinders 118 are connected to the previously mentioned cross pins 121*a* so that the assemblages 116 depend from the cross pins in the manner shown in FIGS. 10A and 10B.

Figure 16:
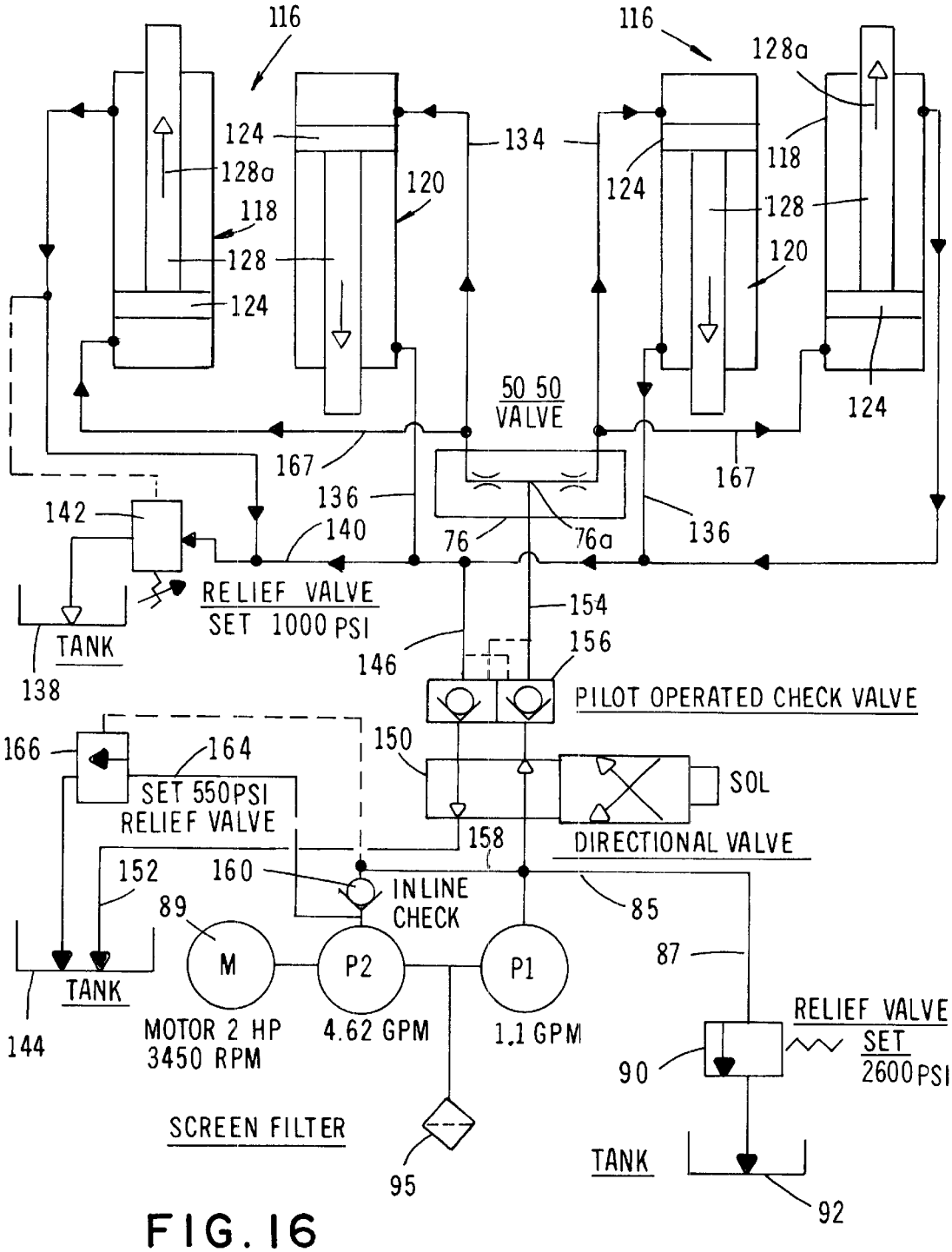
FIG. 16 is a generally schematic view illustrating the construction of the hydraulic operating system of this alternate form of the apparatus of the invention for moving the compaction rams from the upper most position shown in FIGS. 10A and 10B to the compaction position shown in FIGS. 12A and 12B.

As illustrated in FIG. 16, hydraulic lines 134 extend from a 50/50 valve 76, which is of the character previously described, to the upper portion of each of the hydraulic cylinders 120 so that hydraulic fluid introduced into the upper portions of the cylinder will force pistons 124 downwardly therewithin in the manner shown in FIGS. 12A and 12B. Extending from the lower end of each of the cylinders 120 are hydraulic lines 136 that function to interconnect hydraulic cylinders 120 with a tank 138 via a hydraulic line 138 and a conventional relief valve 142 preferably set at about 1000 pounds per square inch (p.s.i.).

As illustrated in FIG. 16, hydraulic line 140 also communicates with tank 144 via a hydraulic line 146, a conventional pilot-operated check valve 148, a conventional directional valve 150 and a hydraulic line 152. The central port 76*a* of 50/50 valve 76 communicates with a Pump P-1 via hydraulic line 154, a conventional pilot-operated check valve 156 and directional valve 150. Hydraulic line 154 also communicates with a Pump P-2 via a hydraulic line 158 and an in-line check valve 160.

As before, Pumps P-1 and P-2 are driven by a conventional two horsepower electrical motor 89 and Pump P-1 communicates with a tank 92 via lines 85 and 87 and via a relief valve 90. Similarly, Pump P-2 communicates with tank 144 via a hydraulic line 164 and a conventional relief valve 166 preferably set at about *550* p.s.i. All of the components of the hydraulic system that are interconnected in the manner shown in FIG. 16 are readily commercially available and are of a character well understood by those skilled in the art. The relief valves 90, 142 and 166 are, of course, incorporated into the hydraulic system for safety purposes and, as before, a screen filter 95 communicates with Pumps P-1 and P-2 in order to filter particulates from the hydraulic fluid.

It is to be understood that, depending upon the end application to be made of the apparatus of the invention, hydraulic assemblies 118 and 120 can be of various sizes and the hydraulic system used to provide working fluid to the cylinders can be varied from that shown in FIG. 16 in manners well understood by those skilled in the art.

In operating the apparatus of the invention, with the top open container in position within the lower portion of the housing 114, the hingedly connected door 96 can be swung open. With the door open, waste materials can be placed in the top open container with relative ease. When the trash within the container has reached the level within the stroke of the twin compaction rams, door 96 is shut and the power is turned on by conventional control switches so as to energize motor 89. When motor 89 is energized, Pump P-1 will provide fluid under pressure to the upper portion of the hydraulic cylinders 120 via hydraulic lines 134, directional valve 150 and check valve 156. This fluid under pressure will tend to force the piston 124 of cylinders 120 downwardly. Simultaneously fluid under pressure will flow into the lower portions of cylinders 118 via hydraulic lines 167 tending to force the pistons of these cylinders upwardly in the manner indicated by the arrows 128*a* of FIG. 16. As illustrated in FIGS. 12A and 12B, this movement of pistons 124 will simultaneously force the compaction rams 42 and 44 downwardly from the position shown in FIGS. 10A and 10B to the position shown in FIGS. 12A and 12B so as to exert an even compaction force on the waste material contained within the top open container 18. It is to be noted that as the compaction rams move downwardly the hydraulic assemblies 116 also move downwardly within housing 116 to the positions shown in FIGS. 12A and 12B. As the twin rams move toward the bottom of the stroke the trash will begin to compact imparting only a downward force against the trash, but also a horizontal force toward the sides of the container.

As the pistons 124 of the hydraulic assemblies move within their respective hydraulic cylinders, the hydraulic fluid contained within the cylinders will be forced to flow into tank 144 in the manner shown in FIG. 16 for reuse in the next cycle upon the selective operation of directional valve 150. Prior to the commencement of the next compaction cycle, the pistons 124 will, of course, be moved into the starting position shown in FIGS. 10A and 10B.

As is in the earlier described embodiment of the invention, a center dividing wall assembly 98 which along with the side walls of housing 16 guide the travel of the compaction rams evenly and smoothly downwardly from the upper position to the lower trash compaction position shown in FIGS. 12A and 12B. Clearance is strategically provided between the central wall assembly 94 and the side walls 96 of the housing so that the compaction rams, which can pivot slightly about pivot pin 68 will permit the compaction rams to travel smoothly downwardly into the trash container without seizing or binding within the upper portion of housing 16.

As earlier discussed, conventional limit switches are provided so that the compactor will not operate unless a container is positioned within the lower portion of housing 114 and secured in position by the locking means of the invention.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for compacting waste comprising:

(a) a housing having an upper portion and a lower portion, said upper portion having a center dividing wall;

(b) a top open container for receiving the waste to be compacted, said container being movable from a first position within said lower portion of said housing and a second position outwardly of said housing;

(c) first and second compaction rams carried by said housing for simultaneous movement between an upper position within said upper portion of said housing and an extended position within said top open container; and (d) operating means connected to said first and second compaction rams for controllably moving each of said compaction rams between said upper position and said extended positions, said operating means comprising a first hydraulic assembly pivotally connected to said first ram and a second hydraulic assembly connected to said ram.

2. The apparatus as defined in claim 1 in which said top open container includes interconnected front, side and bottom panels and in which said container further includes a side beam connected to each of said side panels.

3. The apparatus as defined in claim 2 in which said lower portion of said housing includes spaced apart rails for engagement by said side beams when said top open container is in said first position.

4. The apparatus as defined in claim 2 further including locking means for locking said top open container within said first position.

5. The apparatus as defined in claim 2 in which said upper portion of said housing is provided with an access door movable from a first closed position to a second open position.

6. The apparatus as defined in claim 2 in which each of said first and second hydraulic assemblies include a connecting rod having connector means for pivotally connecting said connector rod.

7. An apparatus for compacting waste comprising:

(a) a housing having a closed-in upper portion and a front open lower portion, said closed-in upper portion having a center dividing wall and said open lower portion including spaced-apart rails;

(b) a top open container for receiving the waste to be compacted, having first and second side panels and said container being movable from a first position within said front open lower portion of said housing and a second position outwardly of said housing, said top open container further including a side beam connected to each of said first and second side panels, said side beams being so constructed to engage said spaced-apart rails of said housing when said top open container is in said first position (c) first and second rams connected to said housing for simultaneous movement between an upper position within said upper closed-in portion of said housing and an extended position wherein said rams are disposed within said top open container; and (d) operating means connected to said first and second rams for controllably moving said rams between said upper position and said extended position, said operating means comprising a first hydraulic assembly pivotally connected to said first ram and a second hydraulic assembly pivotally connected to said second ram.

8. The apparatus as defined in claim 7 further including locking means for locking said top open container within said first position.

9. The apparatus as defined in claim 8 in which said closed-in upper portion is provided with an access door movable from a first closed position to a second open position.

10. The apparatus as defined in claim 8 in which each of said first and second hydraulic assemblies include a connecting rod having connector means for pivotally connecting said connecting rod to a selected one of said compaction rams.

11. An apparatus for compacting waste comprising:

(a) a housing having a closed-in upper portion and a front open lower portion, said closed in upper portion having side walls and a center dividing wall;

(b) a top open container for receiving the waste to be compacted, said container being movable from a first position within said front open lower portion of said housing and a second position outwardly of said housing;

(c) first and second compaction rams connected to said housing and disposed proximate said center dividing wall for simultaneous movement between an upper position within said upper closed-in portion of said housing and an extended position within said housing and an extended position within said top open container, each of said first and second rams having a bottom wall provided with a generally centrally located connector member; and (d) operating means connected to said first and second rams for controllably moving said rams between said upper position and said extended position within said top open container, said operating means comprising a first hydraulic assembly pivotally connected to said generally centrally located connector member of said first ram and a second hydraulic assembly pivotally connected to said generally centrally located connector member of said second ram.

12. The apparatus as defined in claim 10 in which said side walls and said center dividing wall of said closed-in upper portion comprises guide means for guiding vertical travel of said first and second rams.

13. The apparatus as defined in claim 10 in which said front open lower portion of said housing includes spaced-apart rails and in which said top open container includes side beams engageable by said rails when said top open container is in said first position.

14. The apparatus as defined in claim 10 in which said first and second hydraulic assemblies each comprise a pair of hydraulic cylinders.

15. The apparatus as defined in claim 10 in which said closed-in portion is provided with an access door movable from a first closed position to a second open position.

16. The apparatus as defined in claim 15 further including safety means for preventing movement of said first and second rams from said top position when said access door is in said second open position.

17. An apparatus for compacting waste comprising:

(a) a housing having an upper portion and a lower portion, said upper portion having side walls and a center dividing wall;

(b) a top open container for receiving the waste to be compacted, said container being movable from a first position within said lower portion of said housing and a second position outwardly of said housing;

(c) first and second compaction rams carried by said housing proximate said center dividing wall for simultaneous movement between an upper position within said upper portion of said housing and first extended position within said housing and a second extended position within said top open container; and (d) operating means connected to said first and second compaction rams for controllably moving said compaction rams between said upper position and said first and second extended positions, said operating means comprising a first hydraulic assembly pivotally connected to said first ram and a second hydraulic assembly pivotally connected to said second ram.

18. The apparatus as defined in claim 17 further including a piston reciprocally movable within each of said first and second hydraulic assemblies and a connecting rod connected to each said piston, one of said connecting rods being pivotally connected to said upper portion of said housing.

19. The apparatus as defined in claim 18 in which said side walls and said center dividing wall of said closed-in upper portion of said housing comprises guide means for guiding vertical travel of said first and second rams.

20. The apparatus as defined in claim 19 in which said lower portion of said housing includes spaced-apart rails and in which said top open container includes side beams engageable by said rails when said top open container is in said first position.

* * * * *